US006405651B1

(12) United States Patent
Bennett et al.

(10) Patent No.: US 6,405,651 B1
(45) Date of Patent: Jun. 18, 2002

(54) ELECTROCOATING PROCESS FOR MAKING LITHOGRAPHIC SHEET MATERIAL

(75) Inventors: David S. Bennett, Davenport; Sallie L. Blake, Long Grove, both of IA (US); Robert E. Bombalski, New Kensington, PA (US); Kenneth A. Bowman, Apollo, PA (US); Joseph D. Guthrie, Murrysville, PA (US); Thomas L. Levendusky, Greensburg, PA (US); David L. Serafin, Wexford, PA (US); Jean Ann Skiles, Gibsonia, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/519,018

(22) Filed: Mar. 3, 2000

(51) Int. Cl.[7] ..... B41C 1/10; B41N 1/08; C25D 9/02

(52) U.S. Cl. ..... 101/463.1; 101/457; 101/465; 101/466; 101/467; 204/496

(58) Field of Search ..... 101/454, 457, 101/458, 459, 463.1, 465–467; 204/492–498

(56) References Cited

U.S. PATENT DOCUMENTS

| | | | | | |
|---|---|---|---|---|---|
| 3,962,060 | A | | 6/1976 | Brasko et al. | 204/181 |
| 4,036,136 | A | * | 7/1977 | Takagi | 101/467 |
| 4,263,194 | A | * | 4/1981 | Turpin | 204/493 |
| 4,492,616 | A | * | 1/1985 | Pliefke et al. | 101/459 |
| 4,911,075 | A | | 3/1990 | Lewis et al. | 101/453 |
| 5,145,758 | A | * | 9/1992 | Kossmehl et al. | 101/463.1 |
| 5,153,095 | A | | 10/1992 | Kawamura et al. | 430/175 |
| 5,249,525 | A | | 10/1993 | Lewis et al. | 101/453 |
| 5,379,698 | A | | 1/1995 | Nowak et al. | 101/454 |
| 5,636,572 | A | * | 6/1997 | Williams et al. | 101/457 |
| 5,691,114 | A | * | 11/1997 | Burberry et al. | 101/457 |
| 5,711,991 | A | * | 1/1998 | Robinson et al. | 101/458 |
| 5,713,387 | A | | 2/1998 | Gelbart | 101/467 |
| 5,795,647 | A | * | 8/1998 | Robinson et al. | 430/302 |
| 5,965,326 | A | | 10/1999 | Ellis | 430/309 |
| 5,988,066 | A | | 11/1999 | Robinson et al. | 101/457 |
| 6,004,723 | A | * | 12/1999 | Figov | 430/303 |
| 6,014,929 | A | * | 1/2000 | Teng | 101/456 |
| 6,186,067 | B1 | * | 2/2001 | Rorke et al. | 101/467 |

* cited by examiner

*Primary Examiner*—Stephen R. Funk
(74) *Attorney, Agent, or Firm*—Julie W. Meder; Glenn E. Klepac

(57) ABSTRACT

A process for making lithographic sheet material suitable for imaging by laser radiation. A metal substrate is electrocoated in a bath containing a polymeric resin and laser-sensitive particles, thereby depositing a laser ablatable layer on a principal surface of the metal substrate. In one embodiment, the laser-ablatable layer is treated with a corona discharge for a time sufficient to render the layer non-ink wettable. In other preferred embodiments, the laser-ablatable layer is overcoated with an overlayer such as a non-ink wettable silicone layer or a water-wettable layer comprising an organophosphorus polymer, preferably a copolymer of acrylic acid and vinylphosphonic.

16 Claims, 1 Drawing Sheet

ELECTROCOATING PROCESS FOR MAKING LITHOGRAPHIC SHEET MATERIAL

FIELD OF THE INVENTION

The present invention relates to lithographic sheet materials suitable for imaging by digitally controlled laser radiation. More particularly, the invention relates to an improved process for making such materials.

BACKGROUND OF THE INVENTION

Printing plates suitable for imaging by digitally controlled laser radiation are produced commercially. However, the existing processes for making such plates are expensive and wasteful. Accordingly, there still remains a need for a more efficient and economical process of making such plates.

Laser radiation suitable for imaging printing plates preferably has a wavelength in the near-infrared region, between about 700 and 1500 nm. Solid state laser sources ("commonly termed semiconductor lasers") are economical and convenient sources that may be used with a variety of imaging devices. Other laser sources such as $CO_2$ lasers and lasers emitting light in the visible wavelengths are also useful.

Laser output can be provided directly to the plate surface via lenses or other beam-guiding components, or transmitted to the surface of a blank printing plate from a remotely sited laser through a fiber-optic cable. A controller and associated positioning hardware maintains the beam output at a precise orientation with respect to the plate surface, scans the output over the surface, and activates the laser at positions adjacent selected points or areas of the plate. The controller responds to incoming image signals to produce a precise negative or positive image. The image signals are stored as a bitmap data file on the computer. Such files may be generated by a raster image processor (RIP) or other suitable means. For example, a RIP can accept data in page-description language, which defines all of the features required to be transferred onto a printing plate, or as a combination of page-description language and one or more image data files. The bitmaps are constructed to define the hue of the color as well as screen frequencies and angles.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, it is generally preferable (for reasons of speed) to employ a plurality of lasers and guide their outputs to a single writing array. The writing array is then indexed, after completion of each pass across or along the plate, a distance determined by the number of beams emanating from the array, and by the desired resolutions (i.e., the number of image points per unit length.)

Some prior art patents disclosing printing plates suitable for imaging by laser ablation are Lewis et al U.S. Pat. Nos. 5,339,727 and 5,353,705 and Nowak et al Re. U.S. Pat. No. 35,512. The disclosures of those patents are incorporated herein, to the extent consistent with our invention.

Although these prior art printing plates perform adequately, they are expensive to produce because the absorbing layer is vapor deposited onto the oleophilic polyester layer. Adhesive bonding of the polyester layer to a metal substrate also adds to the cost.

A principal objective of the present invention is to provide a process for making lithographic sheet material wherein a laser-ablatable layer is deposited on a substrate by electrocoating. The electrocoating process of our invention coats metal substrates at greater speed and with improved quality compared to prior art processes such as laminating, adhesive bonding, extrusion coating, and roll coating.

A related objective of our invention is to provide a process suitable for making both positive and negative lithographic plates.

Additional objectives and advantages of our invention will become apparent to persons skilled in the art from the following description of some preferred embodiments.

SUMMARY OF THE INVENTION

In accordance with the present invention, there is provided an improved process for making lithographic sheet material suitable for imaging by laser radiation. The process of our invention is useful for making negative printing plates and for making positive printing plates.

The process of the invention makes lithographic sheet material by coating a substrate with one or more polymeric layers. The substrate is a metal, preferably an aluminum alloy or steel. Some suitable aluminum alloys include alloys of the AA 1000, 3000, and 5000 series. Aluminumnalloys of the AA 5000 series containing about 0.5–10 wt. % magnesium are particularly preferred. Suitable steel substrates includes mild steel sheet and stainless steel sheet.

An aluminum alloy substrate should have a thickness of about 1–30 mils, preferably about 5–20 mils, and more preferably about 8–20 mils. An unanodized aluminum alloy substrate having a thickness of about 8.8 mils is utilized in a particularly preferred embodiment.

A principal surface of the metal surface is cleaned to remove surface contaminants, mainly lubricant residues. Some suitable chemical surface cleaners include alkaline and acid aqueous solutions. Plasma radiation and laser radiation may also be utilized. After the principal surface is cleaned, it is coated with a laser-ablatable layer by electrocoating.

The electrocoating process of our invention may be either anodic electrocoating or cathodic electrocoating. The anodic process involves immersing a continuous coil of aluminum alloy sheet into an aqueous electrocoating bath. The sheet is grounded and an electric current is passed between a cathode in the bath and the sheet. The bath contains an emulsified polymeric resin and laser-sensitive particles combined with an acrylic resin. Total solids content of the bath is generally about 5–20 wt. %.

The laser-sensitive particles are preferably particles of a metal, mineral, or carbon having an average particle size of about 7 microns or less. The preferred metals include iron, aluminum, nickel, and zinc. The mineral may be iron oxide, alumina, titania, or zinc oxide. Laser-sensitive forms of carbon include carbon black and graphite. Iron oxide particles having an average size of less than 1 micron are particularly preferred. Content of the laser-sensitive particles in the coating bath maybe as low as 1 ppm and as high as 50 wt. %, is preferably about 1–10 wt. % and is about 5 wt. % in a particularly preferred embodiment.

The emulsified polymeric resin in the bath preferably comprises a polymer of acrylic acid or methacrylic acid, or their analogs and esters, alone or in mixtures and copolymers with an epoxy resin. Carboxylic acid groups on the acrylic polymer are neutralized by a base, preferably an organic amine.

Electric current passing through the bath electrolyzes water, generating hydronium ions at the sheet surface. The hydronium ions react with amine groups on the polymeric resin, liberating the acrylic polymer that precipitates on the sheet surface. Similarly, amine groups on molecules of acrylic resin combined with the laser sensitive particles are also neutralized, thereby precipitating the particles along with the polymeric resin as a laser-ablatable layer on the sheet surface. When the metal substrate comprises an aluminum alloy, the electric current also generates a thin layer of anodic oxide between the metal and the laser-ablatable layer.

The electrocoating process is self-limited. As the coating thickness increases, its electrical resistance also rises thereby limited the amount of coating deposited. Coating thickness is also limited by the high speed at which the metal sheet passes through the bath, and by the bath composition. The coating may have a thickness of about 0.01–1 mil. A coating having a thickness of about 0.1 mil (2.5 microns) is particularly preferred. The laser-sensitive particles make up about 5 wt. % of the coating in a particularly preferred embodiment.

The electrocoated laser-ablatable layer of polymeric resin and laser-sensitive particles is cured by heating to a temperature of about 100–300° C. for a few seconds or less.

The cured, electrocoated sheet may be used directly as a negative printing plate for applications in which an ink-wettable top surface is desired. Alternatively, the laser-ablatable layer is treated with a corona discharge to produce a top surface that is water-wettable.

As used herein the term "corona discharge" refers to a treatment in which air or other gas is ionized in close proximity to the coating surface. Ionization of the gas is initiated by passing a high voltage current through an electrode in close proximity to the surface, thereby causing oxidation and other changes on the coating surface. Corona discharge is typically operated with a power source providing about 6–20 KV at a frequency of about 2–50 KHz, preferably about 2–30 KHz.

In a second embodiment of the invention whereon a positive printing plate is desired, the laser-ablatable layer is overcoated with a second layer or overlayer. The overlayer is preferably applied by roll coating, typically to a thickness of about 0.01–1.0 mil, preferably about 0.1–0.3 mil.

When a water-wettable overlayer is desired, the overlayer preferably comprises a polymer of an organophosphorus compound. As used herein, the term "organophosphorus compound" includes organophosphoric acids, organophosphonic acids, organophosphinic acids, as well as various salts, esters, partial salts, and partial esters thereof. The organophosphorus compound may be copolymerized with acrylic acid or methacrylic acid. Copolymers of vinyl phosphonic acid are preferred, especially the copolymers containing about 5–50 mole % vinyl phosphonic acid and about 50–95 mole % acrylic acid and having a molecular weight of about 20,000–100,000. Copolymers containing about 70 mole % acrylic acid groups and about 30% vinylphosphonic acid groups are particularly preferred.

In a third embodiment of the invention wherein a waterless, positive printing plate is desired, the laser-ablatable layer is overcoated with a second layer or overlayer comprising a silicone or silicate, preferably a silicone. The silicone overlayer is preferably applied by roll coating, typically to a thickness of about 0.01–1.0 mil, preferably about 0.1–0.3 mil. The silicone overlayer repels both water and oleophilic inks.

DETAILED DESCRIPTION OF PREFERRED EMBODIMENTS

Figure 1:
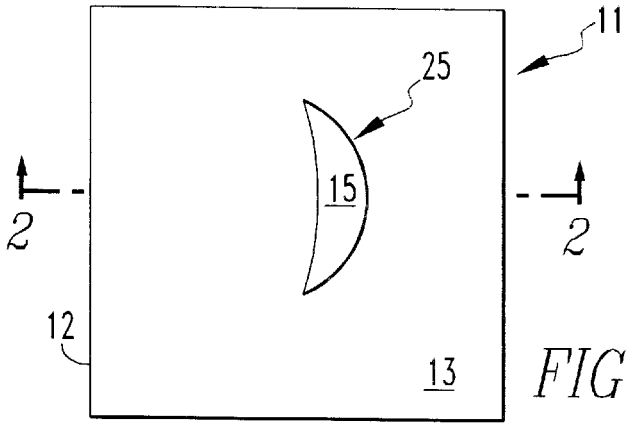
FIG. 1 is a schematic, top plan view of a first embodiment of the lithographic printing plate made in accordance with the present invention after exposure to the laser beams shown in FIG. 2.
Figure 2:
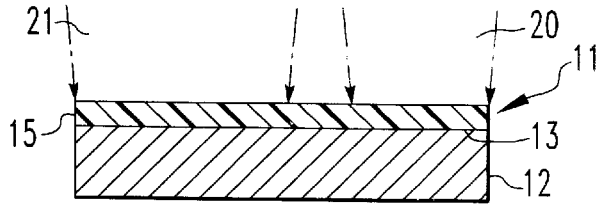
FIG. 2 is a cross-sectional view taken along the lines 2—2 of FIG. 1.

In FIGS. 1 and 2 there is shown a first embodiment of lithographic sheet material 11 made in accordance with the present invention. The material 11 includes an unanodized aluminum alloy substrate 12 having a principal surface 13 coated with a laser-ablatable layer 15. The substrate 12 has a thickness of about 8.8 mils.

The laser-ablatable layer 15 has a thickness of about 0.1 mil (2.5 microns) and contains about 95 wt. % of a mixture of acrylic and epoxy polymers, together with about 5 wt. % iron oxide particles having an average particle size of less than about 1 micron. The layer 15 is applied to the principal surface 13 by electrocoating.

Laser beams 20, 21 shown in FIG. 2 impinge upon the laser-ablatable layer 15, thereby producing the image area 25 shown in FIG. 1. The image area 25 is wettable by oleophilic printing inks and the principal surface 13 of FIG. 1 is water-wettable.

Figure 3:
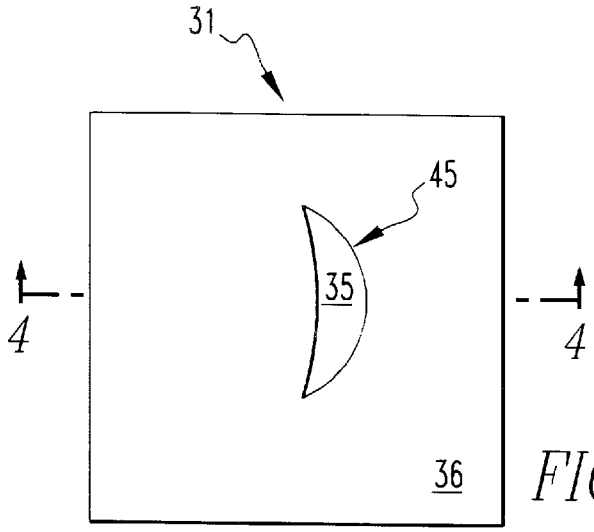
FIG. 3 is a schematic, top plan view of a second embodiment of the lithographic printing plate of the present invention after exposure to the laser beam shown in FIG. 4.
Figure 4:
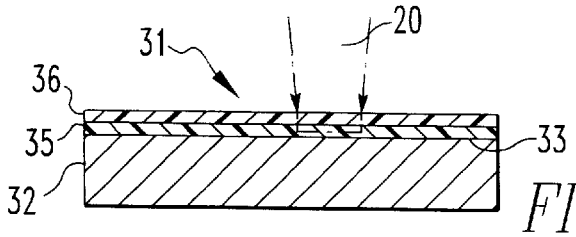
FIG. 4 is a cross-sectional view taken along the lines 4—4 of FIG. 3.

An alternative embodiment shown in FIGS. 3 and 4 of lithographic sheet material 31 includes an unanodized aluminum alloy sheet substrate 32 having a principal surface 33 coated with a laser-ablatable layer 35. The substrate 32 has a thickness of about 8.8 mils.

The laser-ablatable layer 35 has a thickness of about 0.1 mil (2.5 microns) and it contains about 95 wt. % of a mixture of acrylic and epoxy polymers, together with about 5 wt. % iron oxide particles having an average particle size of less than about 1 micron. The laser-ablatable layer 35 is applied to the principal surface 33 by electrocoating.

The laser-ablatable layer 35 is overcoated with an overlayer 36 having a thickness of about 0.01–0.3 mil. The overlayer 36 preferably comprises a water-wettable copolymer of acrylic acid and vinylphosphonic acid containing about 70 mole % acrylic acid groups and about 30 mole % vinylphosphonic acid groups. The copolymer has an average molecular weight of about 50,000 to 80,000.

As shown in FIG. 4, a laser beam 20 impinging upon the sheet material 31 ablates the overlayer 36, leaving the image area 45 shown in FIG. 3.

Alternatively, the overlayer 36 may be a silicone or silicate layer having a thickness of about 0.01–0.3 mil. The silicone or silicate is non-wettable by water and by oleophilic printing inks. In this alternative embodiment, the sheet material 31 is useful for waterless printing processes.

Having described the presently preferred embodiments, it is to be understood that the invention may be otherwise embodied within the spirit and scope of the appended claims.

What is claimed is:

1. A process for making lithographic sheet material suitable for imaging by laser radiation, comprising:

a) providing a metal substrate having a principal surface, and b) electrocoating said metal substrate by immersing it as a first electrode in a bath containing a polymeric resin and laser-sensitive particles and passing an electric current between said substrate and a second electrode of polarity opposite said first electrode, to deposit on at least said principal surface a laser-ablatable layer comprising said resin and said particles, wherein said laser-ablatable layer is ink-wettable.

2. The process of claim 1, further comprising d) overcoating said ink-wettable layer with a non-ink wettable overlayer.

3. The process of claim 2, wherein said overlayer comprises a silicone.

4. The process of claim 2, wherein said overlayer is wettable by water.

5. The process of claim 4, wherein said overlayer comprises an organophosphorus polymer.

6. The process of claim 4, wherein said overlayer comprises a vinyl phosphonic acid-acrylic acid copolymer.

7. The process of claim 1, wherein said first electrode is an anode and said second electrode is a cathode.

8. The process of claim 1 wherein said polymeric resin comprises a polymer selected from polyacrylates and polyacrylic acids.

9. The process of claim 1 wherein said particles comprises carbon or metal or mineral particles.

10. The process of claim 1 wherein said particles comprise iron oxide.

11. The process of claim 1, wherein said metal substrate comprises an aluminum alloy or steel.

12. A process for making lithographic sheet material, comprising:

a) providing an unanodized aluminum alloy substrate having a thickness of about 1–30 mils, said substrate having a principal surface, b) electrocoating said substrate by immersing it as a first electrode in a bath containing an acrylic resin and laser-sensitive particles and passing an electric current between said substrate and a second electrode of polarity opposite said first electrode, to deposit on said principal surface a laser ablatable layer comprising said acrylic resin and about 1 ppm–50 wt. % of said laser-sensitive particles, said laser-ablatable layer having a thickness of about 0.01–1 mil, wherein said laser-ablatable layer is ink-wettable.

13. The process of claim 12, wherein said particles comprise iron oxide particles having an average size of less than about 1 micron.

14. A lithographic sheet comprising:

a metal substrate having a water-wettable principal surface; and a laser-ablatable layer containing laser-sensitive particles electrocoated onto said principal surface, wherein said laser-ablatable layer is ink-wettable, and wherein said ink-wettable layer comprises an acrylic polymer or an epoxy resin or both.

15. The lithographic sheet of claim 14 wherein said laser-sensitive particles are selected from the group consisting of a metal, a mineral and carbon.

16. The lithographic sheet of claim 15 wherein said laser-sensitive particles are selected from the group consisting of iron, aluminum, nickel, zinc, iron oxide, alumina, titania, zinc oxide, carbon black and graphite.

* * * * *

UNITED STATES PATENT AND TRADEMARK OFFICE

CERTIFICATE OF CORRECTION

PATENT NO. : 6,405,651 B1
DATED : June 18, 2002
INVENTOR(S) : David S. Bennett et al.

It is certified that error appears in the above-identified patent and that said Letters Patent is hereby corrected as shown below:

Title page,
Item [75], Inventors, "David L. Serafin" should read -- Daniel L. Serafin --.

Column 5,
Line 38, "d)" should read -- c) --.

Signed and Sealed this

Eighteenth Day of November, 2003

JAMES E. ROGAN
*Director of the United States Patent and Trademark Office*